United States Patent [19]

Smith

[11] 4,116,368

[45] Sep. 26, 1978

[54] CLOG-FREE INORGANIC GROUT EMPLACEMENT GUN

[75] Inventor: Colen S. Smith, Spokane, Wash.

[73] Assignee: The United States of America as represented by the Secretary of the Interior, Washington, D.C.

[21] Appl. No.: 751,402

[22] Filed: Dec. 16, 1976

[51] Int. Cl.[2] ..... B05B 7/04; B05B 7/06; B05B 7/14

[52] U.S. Cl. ..... 222/145; 222/193; 239/336; 239/428; 302/20

[58] Field of Search ..... 239/336, 428; 222/132, 222/193, 194, 145; 302/20

[56] References Cited

U.S. PATENT DOCUMENTS

| | | | |
|---|---|---|---|
| 1,420,544 | 6/1922 | Hahn | 302/20 |
| 2,419,410 | 4/1947 | Maurer | 239/336 X |
| 2,955,877 | 10/1960 | Ecal | 302/20 |
| 3,174,693 | 3/1965 | Weber, Jr. | 302/20 X |
| 3,239,146 | 3/1966 | Freda | 239/336 X |
| 3,333,774 | 8/1967 | Demaison | 239/428 X |
| 3,712,681 | 1/1973 | Marino et al. | 239/428 X |
| 3,907,170 | 7/1975 | Schredrin et al. | 222/193 X |

*Primary Examiner*—David A. Scherbel
*Attorney, Agent, or Firm*—Gersten Sadowsky; Donald A. Gardiner

[57] ABSTRACT

This disclosure is directed to a clog-free grout emplacement gun particularly adapted for use in coal or similar mines for retaining roof bolts in bore holes, and includes a first conduit for conveying a gaseous medium along a first path, a second conduit for conveying grout material along a second path, a mixing chamber for admixing the gaseous medium and the grout material, a passage for directing the admixed gaseous medium and grout material along a third path toward and beyond a discharge orifice of a nozzle toward a predetermined point, a tube for directing a liquid medium along a fourth path paralleling the third path outwardly of the discharge nozzle, and a control device for controlling the flow of the media and material to effect admixture thereof at a point beyond the orifice of the discharge nozzle.

5 Claims, 3 Drawing Figures

CLOG-FREE INORGANIC GROUT EMPLACEMENT GUN

Figure 1:
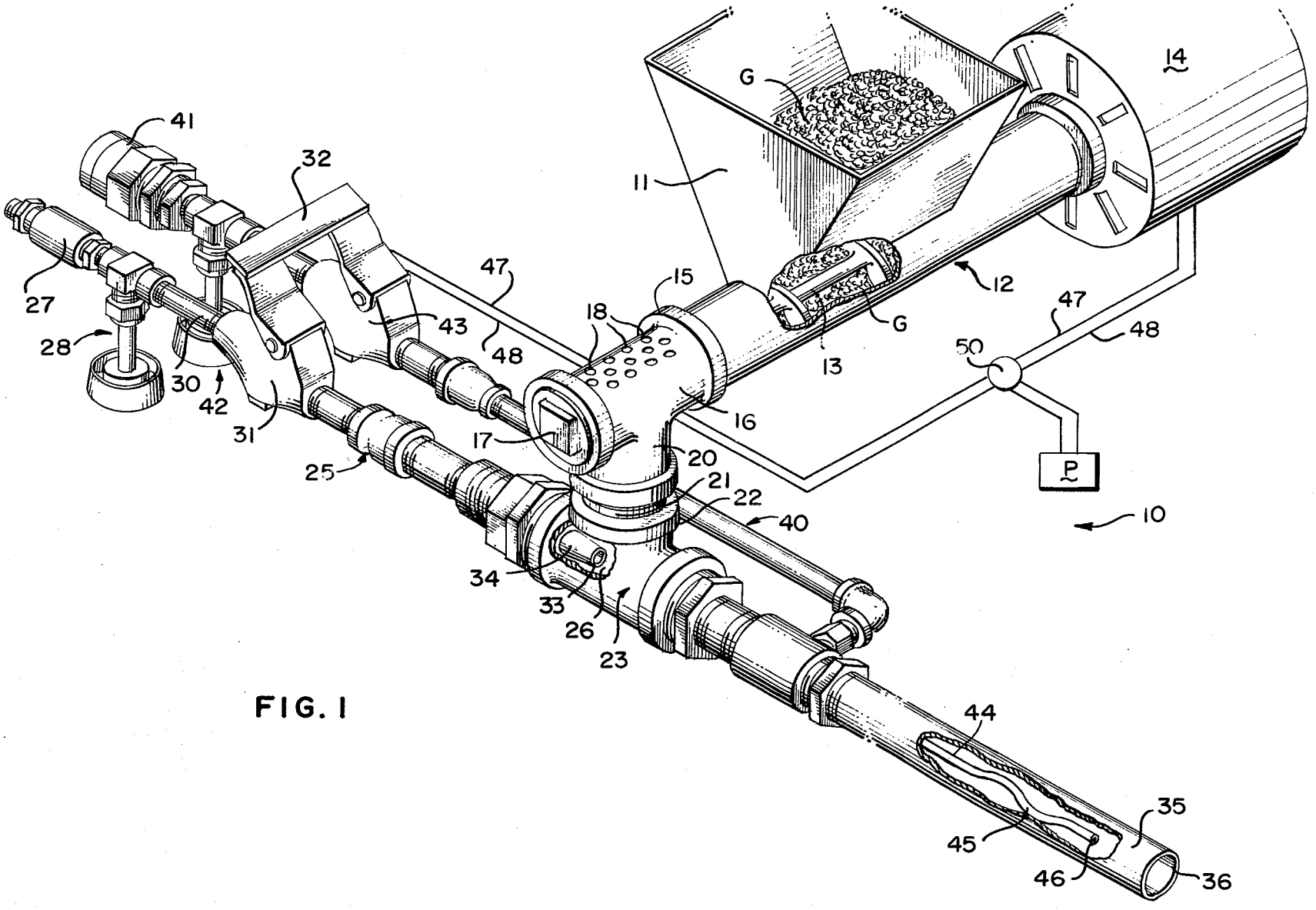

The present invention is directed to a novel apparatus for and method of emplacing cementitious grout material and a liquid in a mine bore or rock bolt hole for retaining therein a rock bolt. Conventionally, rock bolt drill holes are drilled in mine roofs 4 to 6 or more feet in depth and of a diameter of 1 inch to 1⅝ inch. Rock bolts or dowels may vary in diameter from ½ inch to 1 inch and are normally installed in a predetermined grid pattern in a mine roof at 3 to 4 foot centers. They are required to provide almost immediate support to the mine roof and the bolt must withstand a pull test equal to one-half the yield strength of its material (generally steel) in 5 minutes. For example, a reinforcing steel dowel or rock bolt 5 feet long and ⅝ inch diameter grouted into a mine roof must withstand a pull of 8,000 pounds in 5 minutes and a pull of 16,000 pounds in 15 minutes or less. In order to achieve these desired results, the grouting material must be implanted in the rock bolt drill holes in a thoroughly admixed condition and the apparatus utilized must be capable of repetitive and non-clogging usage.

Conventional cementitious grouting material sets very rapidly and due to this very short set-up time it is not possible to mix and then inject the grouting material by known conventional methods. Such known inorganic fast setting grouting materials harden in mixers, pumps, hoses, or other equipment before the latter can be cleaned, thereby obviously creating undesired difficulties in any type of inorganic grout emplacement environment.

In view of the foregoing, it is a primary object of this invention to provide a novel apparatus for first admixing inorganic cementitious grout material and air and to direct the latter admixture along a path toward and through a discharge orifice of a nozzle, directing liquid through the same nozzle, and controlling the flow of the latter materials in such a fashion as to prevent their admixture until a point beyond the nozzle orifice whereby the aforementioned disadvantages of known prior art apparatuses are totally eliminated.

A further object of this invention is to provide a novel clog-free inorganic grout emplacement gun including a first conduit for directing a gaseous medium toward a mixing or atomizing chamber, a second conduit for directing cementitious inorganic grouting material toward the mixing chamber whereby the gaseous medium and grout material are admixed and directed toward a discharge orifice of a discharge nozzle, and directing a stream of liquid through the nozzle under controlled conditions such that admixture of the liquid with the admixed gaseous medium and cementitious material does not occur until a point exterior of the discharge orifice.

A further object of this invention is to provide a liquid tube disposed within the discharge nozzle, and means for centrally locating a discharge orifice of the liquid tube to assure admixture of the liquid and the admixed gaseous medium and cementitious material at a point beyond the discharge orifice of the nozzle.

A further object of this invention is to provide a novel method of securing a rock bolt in a bore hole by admixing a gaseous medium and a cementitious grout material, directing its travel along a first path within a nozzle having a discharge orifice, directing a liquid along the same path within the nozzle, and controlling the discharge of the latter materials such that they totally admix only after passing beyond the discharge orifice of the nozzle.

Further objects of the invention will be apparent from a reading of the following detailed description of a preferred embodiment, the appended drawings, and the claims.

Figure 2:
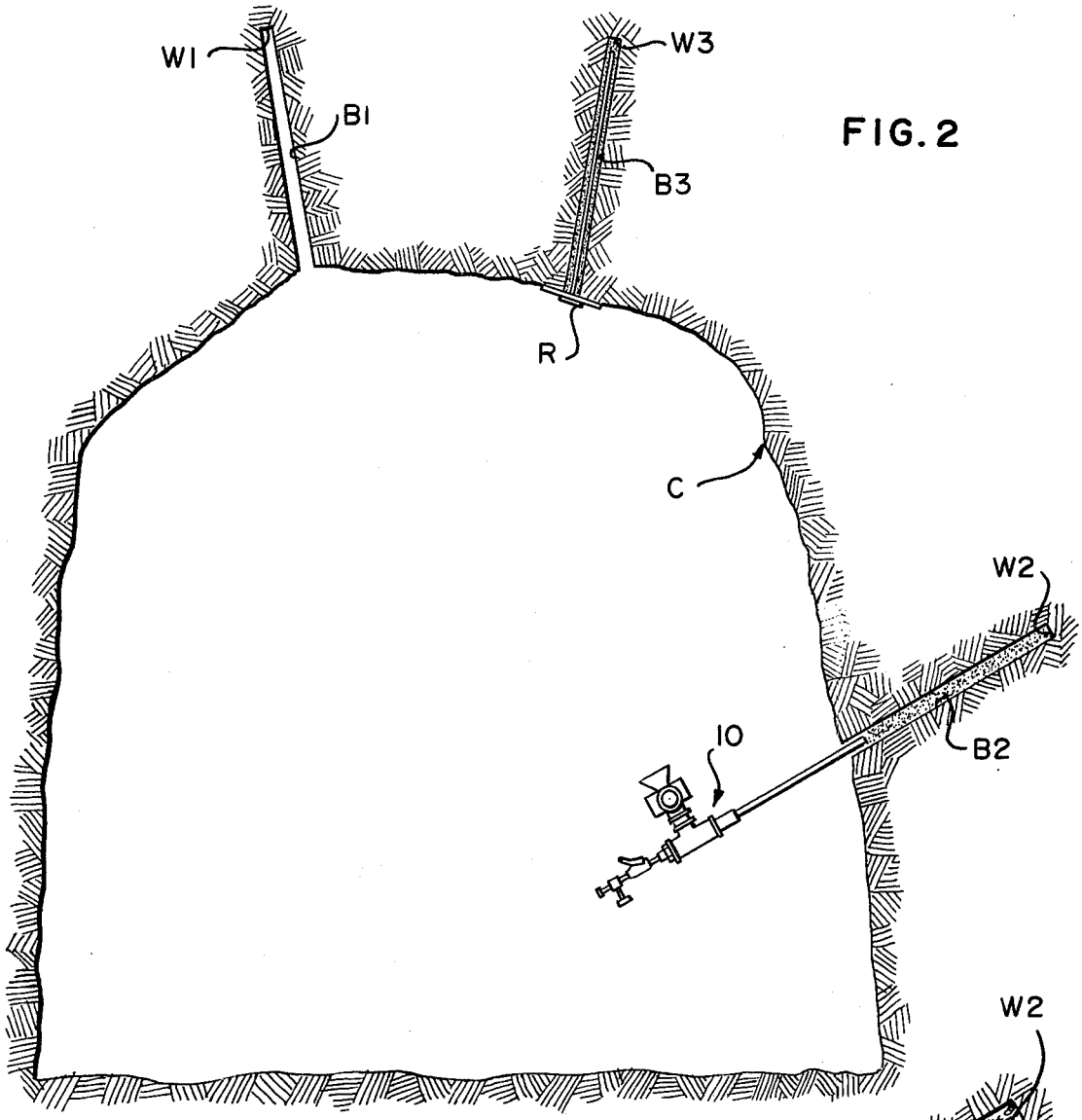
Figure 3:
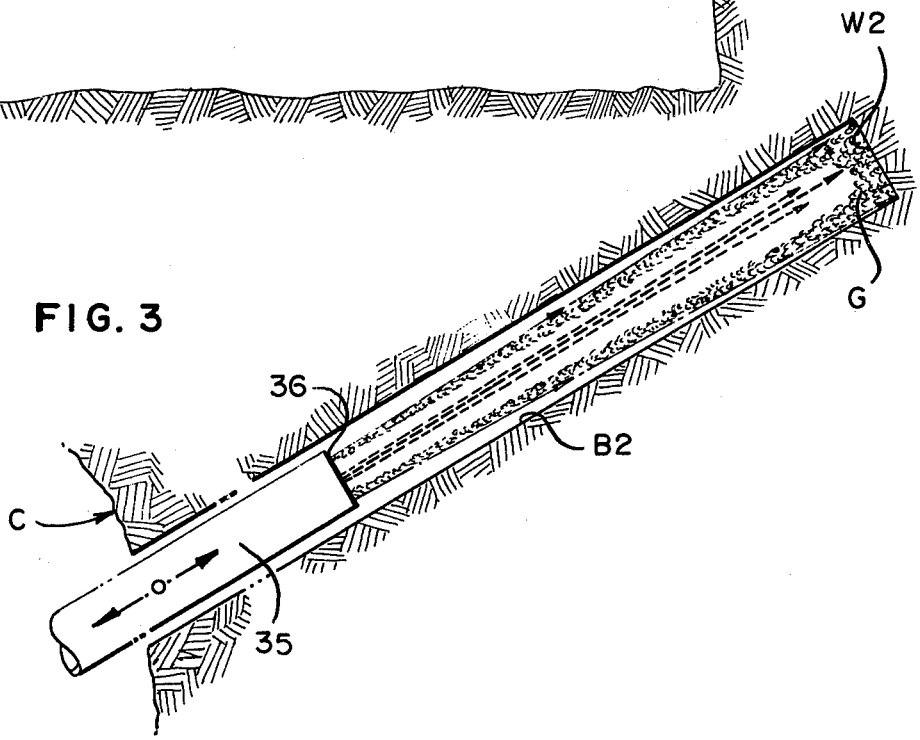

In the drawings:

FIG. 1 is a perspective view with parts broken away for clarity of a clog-free inorganic grout emplacement gun constructed in accordance with this invention and illustrates first and second conduits for guiding gas and grout material, respectively, to a mixing chamber for pneumatic conveyance toward a discharge orifice of a nozzle, and a generally coaxial liquid tube within the nozzle for simultaneously directing liquid outwardly of the discharge orifice;

FIG. 2 is a cross-sectional view of a mine passage illustrating an empty bore hole, a bore hole having implanted therein inorganic grout by the apparatus of FIG. 1, and another bore hole having a roof bolt retained in place by the set inorganic grout; and FIG. 3 is a highly enlarged fragmentary sectional view of the lowermost bore hole of FIG. 2, and illustrates the manner in which the admixed gas and grout material admix with the liquid within the bore hole only after passing beyond the orifice of the nozzle.

A novel clog-free inorganic grout emplacement gun or apparatus constructed in accordance with this invention is fully illustrated in FIG. 1 of the drawings and is generally designated by the reference numeral 10. The gun 10 includes means 11 in the form of a hopper for receiving conventional inorganic cementitious grout or grout material G which when admixed with a liquid will rapidly set and solidify. The hopper 11 is in communication through a lowermost orifice (not shown) with conduit means 12 in the form of a conduit having housed therein a feed screw 13 rotated by a motor 14 of a conventional construction which may be electrically, pneumatically, or otherwise powered. The conduit means or pipe 12 is joined at an end portion 15 to a T-coupling 16 closed by a cap 17 and has a plurality of air intake apertures 18. A leg 20 of the T-coupling 16 is connected by a short exteriorly threaded pipe 21 to an interiorly threaded leg 22 of another T-coupling 23 which functions as a mixing or admixing means in a manner to be described hereinafter.

Second means generally designated by the reference numeral 25 is provided for directing a gaseous medium, such as air, from a suitable source (not shown) toward and into the interior 26 of the T-coupling or mixing chamber 23. The means 25 includes a conventional coupling 27 connected in a conventional manner to a pressure regulating device 28. Air passing behond the regulating device 28 is conducted by a short pipe 30 to a conventional manually operated on-off valve 31 having a pivoted manual actuator 32. Upon pressing the actuator 32 air passes through conventional pipes and couplings (unnumbered) into the chamber 23 through a discharge orifice 33 of a nozzle 34 which creates a venturi effect within the chamber 26 thoroughly admixing therein the grout G and the gas (air). The air is under relatively high pressure and thus the admixed grout and air pass in a stream through additional conventional piping toward a nozzle 35 and outwardly of an orifice 36 thereof.

Means generally designated by the reference numeral 40 is provided for directing liquid (preferably water) toward and into the nozzle 35 at a point upstream of the discharge orifice 36. The means 40 includes a conventional coupling 41 which is connected to a source of pressurized liquid (not shown) such as a liquid pump and/or pressurized reservoir. A conventional regulating device 42 controls the pressure of the water as it passes through conventional piping (not numbered) toward another on-off valve 43 having pivotally connected thereto the manual actuator 32. Obviously, the depression of the manual actuator 32 simultaneously causes both air and water to pass beyond the respective on-off valves 31, 43. The water thus passing beyond the valve 43 is conducted by conventional piping (not numbered) into the nozzle 35 at a point between the interior 26 of the admixing chamber 23 and the discharge orifice 36 of the nozzle 35. The piping is connected internally of the nozzle 35 to a liquid tube 44 having a serpentine end portion 45 which functions to locate a discharge orifice 46 of the liquid tube 44 coaxial to the discharge orifice 36 of the nozzle 35.

A switch (not shown) is located for actuation by depression of the manual actuator to synchronize the simultaneous flow of the air and water with that of the energization of the motor 14 to drive the feed screw 13. The switch is simply a conventional on-off switch connected by conductors 47, 48 to the motor 14, which is hereat presumed to be electrically powered, and an electrical control box 50 connected to a power source P. Thus, upon the depression of the manual actuator 32 the valves 31, 43 open and the screw 13 is rotated so that the various materials (gas, liquid and grout) are simultaneously moved along their respective paths for subsequent discharge through the orifice 36 of the nozzle 35.

The control of the air by the regulating device 28, control of the liquid by the regulating device 42, and control of the speed of rotation of the feed screw 13 by the energization of the motor 14 is such that the liquid exiting from the orifice 46 does not impinge or contact the admixed grout and air flowing through the nozzle 35 until such time as all three components have passed beyond the orifice 36. This occurs even though the orifice 46 of the liquid tube 44 is spaced inwardly from the discharge orifice 36 of the nozzle 35. The purpose for this control is to make absolutely certain that the interior (not numbered) of the nozzle 35 is at no time moistened and thus the apparatus cannot be at any time clogged by the very rapidly setting inorganic grout G.

Reference is now made to FIG. 2 of the drawings in which a mine chamber C is illustrated having therein three drilled rock bolt holes or bores B1, B2 and B3 each having a respective blind end wall W1, W2 and W3. The bore B1 is shown after being drilled and prior to having implanted therein by the apparatus 10 of this invention the grout G. In order to implant the grout G into any one of the bore holes B1–B3, the nozzle 35 of the grout emplacement gun 10 is inserted into, for example, the bore hole B2. Initially, the orifice 36 of the nozzle 35 is inserted into the bore hole B2 closer to the blind end wall W2 than illustrated. When thus positioned the manual actuator 32 is depressed, causing the flow of gas, liquid, and grout G in the manner heretofore described and the discharge of the latter materials outwardly of the orifice 36, again without the liquid at this point moistening the admixed grout G and air. The three materials thus exit the orifice 36 without any wetting occurring prior thereto and such wetting occurs only at a point beyond the orifice 36 with the distance of the point beyond the orifice 36 being suitably regulated by the speed of rotation of the feed screw 13 and the regulation of the regulating devices 28, 42.

FIG. 3 specifically illustrates the materials exiting the orifice 36 of the nozzle 35 without the admixed grout and air being wetted and with the orifice 36 being placed in its inwardmost position relative to the blind wall W2 of the bore hole B2. Once the materials exit the orifice 36 of the nozzle 35 and at a point therebeyond which may be at or spaced from the blind wall W2, admixing of all three materials takes place and is augmented by the natural "churning" action as these materials impinge against the blind wall W2. As more and more of the wetted admixture builds up in the bore B2, the emplacement gun 10 is retracted outwardly of the bore hole B2 so that none of the now wetted admixed material can return toward the orifice 36 sufficiently to enter thereinto in a reverse direction. When a sufficient amount of the wetted admixed material has been implanted within the bore hole B2, the actuating member 32 is released cutting off the flow of water, air and grout and permitting the insertion of a rock bolt into the bore hole B2. As the rock bolt is inserted into the bore hole B2, the wetted grout material is forced in a direction away from the blind wall W2 until substantially the entire bore hole B2 is filled with the grout material in the manner illustrated by a rock bolt R within the bore hole B3. Of course, thereafter the grout dries and/or sets and the rock bolt R is securely retained within the bore hole B3.

From the foregoing it is readily apparent that at no time are the three materials ever in contact with each other until all have exited the orifice 36 of the nozzle 35 and thereby at no time is clogging of the apparatus 10 possible.

The construction shown in the drawings and described is the presently preferred embodiment of the invention, but the disclosure is intended to be illustrative rather than definitive, the invention being defined in the claims.

It is recommended that the grout feed mechanism be activated by compressed air drive rather than by electrical drive, as is indicated herein. Compressed gas (air) must be provided for the basic operation of the grout emplacement gun and pressurization of the wetting agent (water). It follows that the same gas source can readily be used to operate the feed mechanism, rather than provide an additional power source.

What is claimed is:

1. Apparatus for dispensing media comprising first conduit means for guiding a moving gaseous medium between a first point and a second point of said apparatus, said second point being defined by an outlet orifice of said first conduit means, second conduit means for directing solid material into said first conduit means at a third point in said apparatus between said first and second points whereby said solid material is admixed with said gaseous medium and moved thereby toward said second point, third conduit means for directing a liquid toward said orifice outlet, said third conduit means having a terminating portion extending centrally within said first conduit along a longitudinal axis thereof and directing said liquid therein through an end opening in proximity to and facing substantially parallel to a central portion of said outlet orifice, and control means determining movement of said media within said respective conduits whereby effective admixing of said gaseous medium and said solid material with said liquid is essentially precluded until said gaseous medium, said solid material, and said liquid have moved outside said conduits beyond said outlet orifice.

2. The apparatus as defined in claim 1 including means defining a venturi admixing chamber at said third point.

3. The apparatus as defined in claim 1 wherein common valve means of said control means are associated with said first and third conduit means for simultaneously effecting the flow of the respective gaseous medium and liquid toward said second point.

4. The apparatus of claim 2 wherein said liquid traverses said first conduit means and therebeyond from a fourth point of said extended portion of said third conduit disposed between said second and third points.

5. A method of dispensing media comprising the steps of guiding a moving gaseous medium in a conduit extending between a first point and a second point therein with the latter point being defined by an outlet orifice, directing solid material into said gaseous medium at a third point in said conduit between said first and second points whereby said solid material is admixed with said gaseous medium and moved thereby toward said second point, directing a liquid in a further conduit to move centrally within said extended conduit and substantially parallel to a longitudinal axis thereof between said third and second points and toward a fourth point in proximity to said outlet orifice terminating said further conduit at an opening disposed so as to face substantially parallel to a central portion of said outlet orifice, and wherefrom said liquid issues in a tight stream confined within said admixed solid material and gaseous medium whereby effective admixing of said gaseous medium and said solid material with said liquid is essentially precluded until movement thereof is outside said conduits beyond said outlet orifice.

* * * * *